US008490346B2

(12) United States Patent
Wedren

(10) Patent No.: US 8,490,346 B2
(45) Date of Patent: Jul. 23, 2013

(54) INTERNAL ANCHOR BOARD-UP SYSTEM

(75) Inventor: Howard Anthony Wedren, Chicago, IL (US)

(73) Assignee: SecureView LLC, Cleveland, OH (US)

( * ) Notice: Subject to any disclaimer, the term of this patent is extended or adjusted under 35 U.S.C. 154(b) by 0 days.

(21) Appl. No.: 13/076,499

(22) Filed: Mar. 31, 2011

(65) Prior Publication Data

US 2011/0239559 A1 Oct. 6, 2011

Related U.S. Application Data

(60) Provisional application No. 61/319,498, filed on Mar. 31, 2010.

(51) Int. Cl.

| | |
|---|---|
| ***E04B 1/92*** | (2006.01) |
| ***E06B 9/00*** | (2006.01) |
| ***E06B 3/30*** | (2006.01) |
| ***E04G 23/02*** | (2006.01) |

(52) U.S. Cl.
USPC ..... 52/202; 52/203; 52/745.21; 52/DIG. 12; 49/50; 49/57; 49/463

(58) Field of Classification Search
USPC .... 52/202, 203, 106, 745.21, DIG. 12; 49/57, 49/463, 50, 54, 465
See application file for complete search history.

(56) References Cited

U.S. PATENT DOCUMENTS

| | | | | |
|---|---|---|---|---|
| 2,549,661 | A * | 4/1951 | Carney | 52/202 |
| 3,871,434 | A * | 3/1975 | Hance | 160/91 |
| 3,978,614 | A | 9/1976 | Goldhaber | |
| 4,174,596 | A * | 11/1979 | Deibele | 52/202 |
| 4,203,256 | A | 5/1980 | Mowry | |
| 4,221,091 | A * | 9/1980 | Ganse et al. | 52/202 |
| 4,562,666 | A | 1/1986 | Young, III | |
| 4,665,676 | A | 5/1987 | Drzemala | |
| 4,726,149 | A * | 2/1988 | Tryba | 49/465 |
| 4,938,154 | A * | 7/1990 | Watt | 109/49.5 |
| 5,339,567 | A * | 8/1994 | Pierpont et al. | 49/55 |
| 5,487,237 | A * | 1/1996 | Martin, Jr. | 49/57 |
| 5,540,018 | A * | 7/1996 | Biggers | 52/202 |
| 5,673,883 | A | 10/1997 | Figueroa, Jr. | |
| 5,911,660 | A * | 6/1999 | Watson | 52/202 |
| 5,937,593 | A | 8/1999 | White | |
| 5,941,031 | A * | 8/1999 | Fullwood | 52/202 |
| 6,155,009 | A * | 12/2000 | Pena | 52/202 |
| 6,205,713 | B1 * | 3/2001 | Thompson et al. | 49/465 |

(Continued)

FOREIGN PATENT DOCUMENTS

| | | | |
|---|---|---|---|
| GB | 2160248 | A | 12/1985 |
| GB | 2288200 | A * | 10/1995 |

(Continued)

*Primary Examiner* — Basil Katcheves
*Assistant Examiner* — Rodney Mintz
(74) *Attorney, Agent, or Firm* — Miler, Matthias & Hull LLP

(57) ABSTRACT

An internal anchor board-up system for windows is disclosed. The internal anchor board-up system may include an exterior window cover, one or more interior clamping beams, and bolts or fasteners connecting the cover to the beam. The exterior cover is preferably transparent, such as a plexiglass cover, so that the internal anchor board-up system is substantially more aesthetically pleasing than traditional board-up systems relying upon plywood. Further, a transparent plexiglass or acrylic cover is stronger and harder to cut through than plywood.

10 Claims, 11 Drawing Sheets

U.S. PATENT DOCUMENTS

| | | | | |
|---|---|---|---|---|
| 6,219,978 | B1 | 4/2001 | Wood | |
| 6,263,625 | B1 * | 7/2001 | LaPointe | 52/202 |
| 6,293,059 | B1 * | 9/2001 | Goodwin | 52/202 |
| 6,295,773 | B1 | 10/2001 | Alty | |
| 6,296,041 | B1 * | 10/2001 | Cicero | 160/327 |
| 6,314,689 | B1 * | 11/2001 | Hughes | 52/203 |
| 6,334,282 | B1 | 1/2002 | Wood | |
| 6,341,455 | B1 * | 1/2002 | Gunn | 52/202 |
| 6,363,670 | B1 | 4/2002 | Dewitt | |
| 6,393,777 | B1 * | 5/2002 | Renfrow | 52/202 |
| 6,502,355 | B1 | 1/2003 | Bori | |
| 6,505,441 | B1 * | 1/2003 | Shuey et al. | 49/463 |
| 6,532,702 | B1 * | 3/2003 | Scribner | 52/202 |
| 6,640,509 | B2 | 11/2003 | Clewis | |
| 6,662,511 | B1 | 12/2003 | Alty | |
| 6,968,660 | B1 * | 11/2005 | Novoa | 52/473 |
| 6,978,579 | B1 | 12/2005 | Trinca | |
| D542,935 | S * | 5/2007 | Tedford | D25/48.7 |
| 7,243,463 | B1 * | 7/2007 | Lucero | 49/465 |
| 7,249,444 | B2 * | 7/2007 | Diamond | 52/514 |
| 7,305,800 | B1 * | 12/2007 | Calfee | 52/203 |
| 7,389,615 | B1 * | 6/2008 | Kelley | 52/202 |
| 7,526,896 | B1 * | 5/2009 | Lohmeyer et al. | 52/202 |
| 7,584,579 | B1 * | 9/2009 | Everitt | 52/202 |
| 7,614,187 | B1 * | 11/2009 | Forbes | 52/202 |
| 7,628,430 | B2 * | 12/2009 | Whitaker | 292/259 R |
| 7,654,044 | B2 * | 2/2010 | Borland | 52/202 |
| D611,170 | S * | 3/2010 | Hiner | D25/138 |
| 7,707,789 | B2 * | 5/2010 | Janesky | 52/169.6 |
| 7,908,803 | B2 * | 3/2011 | Puchniak | 52/202 |
| 8,046,967 | B2 * | 11/2011 | Suare et al. | 52/506.06 |
| D658,781 | S * | 5/2012 | Zimmer, II | D25/57 |
| 8,196,363 | B2 * | 6/2012 | Hay et al. | 52/204.62 |
| 8,297,011 | B2 * | 10/2012 | Quick et al. | 52/202 |
| 2003/0159372 | A1 * | 8/2003 | Motro | 52/202 |
| 2004/0182006 | A1 * | 9/2004 | Petty | 49/56 |
| 2005/0081446 | A1 * | 4/2005 | Muller | 49/57 |
| 2006/0162276 | A1 | 7/2006 | Coleman | |
| 2006/0260234 | A1 * | 11/2006 | Suare et al. | 52/309.2 |
| 2007/0000193 | A1 * | 1/2007 | Beaupre et al. | 52/202 |
| 2007/0204530 | A1 * | 9/2007 | Janesky | 52/169.14 |
| 2008/0040994 | A1 | 2/2008 | Borland | |
| 2008/0110099 | A1 * | 5/2008 | Famulare et al. | 49/465 |
| 2009/0019797 | A1 | 1/2009 | Gunn | |
| 2009/0038243 | A1 * | 2/2009 | Heltai | 52/203 |
| 2009/0044451 | A1 * | 2/2009 | Quick et al. | 49/57 |
| 2009/0094896 | A1 * | 4/2009 | Quick et al. | 49/55 |
| 2009/0151276 | A1 | 6/2009 | Debes, Jr. | |
| 2009/0277108 | A1 * | 11/2009 | Hay et al. | 52/204.62 |
| 2010/0064606 | A1 * | 3/2010 | Devalapura et al. | 52/202 |
| 2011/0048292 | A1 * | 3/2011 | Zimmer, II | 109/64 |
| 2011/0154752 | A1 * | 6/2011 | Grover et al. | 52/202 |
| 2011/0296760 | A1 * | 12/2011 | Auston et al. | 49/54 |
| 2012/0060436 | A1 * | 3/2012 | Zimmer, II | 52/202 |
| 2012/0174507 | A1 * | 7/2012 | Burger | 52/202 |
| 2013/0111832 | A1 * | 5/2013 | Glass et al. | 52/202 |

FOREIGN PATENT DOCUMENTS

| | | | |
|---|---|---|---|
| GB | 2359846 | A * | 9/2001 |
| GB | 2386145 | A * | 9/2003 |
| WO | WO 89/00637 | | 1/1989 |
| WO | WO 2011028198 | A1 * | 3/2011 |

* cited by examiner

INTERNAL ANCHOR BOARD-UP SYSTEM

FIELD OF THE DISCLOSURE

A security closure is disclosed for use in covering openings in a building, for example windows or the like. More specifically, this disclosure relates to an internal anchor board-up system for windows.

BACKGROUND OF THE DISCLOSURE

Ownership of buildings, particularly homes, often presents an attractive target for burglars or other persons attempting to make illegal entry or unwarranted entry into such buildings. The problem is particularly acute when the buildings are uninhabited either for a short or for a long period of time. The problem is even more acute in urban areas where a high rate of crime includes illegal entry into and burglary of buildings.

The problem of defending against such illegal entry and burglary becomes particularly acute when there are a large number of buildings involved spread out over a wide area. Placing a guard in every such building is expensive and impractical. Providing extensive and expensive burglar alarms doesn't solve the problem because burglar alarms allow the burglar or illegal entrant to gain initial access to the interior of a building. Whether he/she is subsequently frightened off by the alarm or by the rapid approach of police or other security officials, such an illegal entrance has already done damage to the property. What is worse, sometimes these alarm systems do not work properly in which no alarm is given, and therefore no deterrent is provided against the continued occupation by the illegal entrant.

A common alternative is the boarding up of houses that have become either abandoned or uninhabited for brief or long periods of time. The most common technique for boarding up a window involves nailing a plywood panel over the opening of the window, with the nails being driven through the plywood panel and into the outer frame or casing of the window. Obviously, this procedure damages the window frame, or at least various components of the window frame such as the side casings (side frame members), head casing (top frame member) and window sill. Another problem with this solution is that it is very easy for a determined burglar or illegal entrant to simply remove the boards and enter the building. This can be accomplished by merely using the claw end of a hammer, a crow bar, a screwdriver, or simply breaking the boards or sawing through them. Very little time is required for a determined illegal entrant to gain access to a building that is boarded up.

Further, the boarding up of windows is unsightly and can contribute to the decline in property values in poverty-stricken neighborhoods or neighborhoods experiencing large numbers of foreclosures or vacancies. The scope of this problem can be appreciated in certain urban areas where literally thousands of houses have been abandoned or condemned. Many of the boarded-up houses become burglarized or otherwise destroyed, and valuable materials removed to such an extent that the resultant values of the house and surrounding houses are reduced.

Further, some homeowners may feel insecure in leaving their homes even for a brief one or two week vacation because there is no readily available means of providing security to their homes in their absence to defend against illegal entry or burglary. Similarly, people owning summer homes and cottages remote from urban areas and which are uninhabited during most of the year may be desirous of an inexpensive and relatively easy way to secure windows. Many homeowners cannot afford expensive and elaborate burglar alarm systems, nor can they afford to hire a guard to stand on the premises during the time of their absence. Furthermore, burglar alarm systems are not appropriate for country homes that are remote from police or other security officials who would be notified by such burglar alarms and who could not reach such premises in sufficient time to prevent damage from an illegal entrant or burglar. However, boarding up windows, as indicated above, is ineffective against a determined illegal entrant or burglar, it damages the window and is very unsightly.

Accordingly, there is a need for an improved system for securing windows of abandoned buildings, unoccupied buildings or buildings that are occupied temporarily or seasonally. Such an improved system should provide a more aesthetically appealing appearance than plywood boarding and less damage to the structure of the window.

SUMMARY OF THE DISCLOSURE

In satisfaction of the above needs, an internal anchor board-up system for a window is disclosed. The internal anchor board-up system may include an exterior window cover, an interior clamping beam, and fasteners connecting the cover and beam.

In a refinement, the exterior cover may be sized to fit within a window frame or it may be sized to fit over a window frame.

In a refinement, two clamping beams are utilized.

In another refinement, the exterior cover is transparent. Such a transparent material may be plexiglass or another suitable, durable and shatterproof material.

In a refinement, two clamping beams are used and are disposed parallel with respect to each other.

In another refinement, the clamping beams are used in a horizontal orientation.

In another refinement, each clamping beam includes two opposing ends. Each end includes a foot or support for engaging an interior surface in supporting the clamping beam above the interior surface. For example, a window frame member or a casing member might be damaged from clamping pressure imposed by the clamping beam. In this situation, clamping beams with feet or supports at either end can support the clamping beam above the interior frame or casing member, thereby avoiding damage to the interior of the window.

A kit for boarding windows is also disclosed. The kit includes a first exterior cover, first interior clamping beam and a plurality of fasteners for passing through a window pane or an opening in the event the window pane is broken and connecting the cover to the clamping beam.

In a refinement, the kit may include a second clamping beam. In a further refinement, the kit may include two exterior covers and two sets of clamping beams, for use with a double hung window.

A method for boarding up a window is also disclosed. The method includes providing exterior cover sized to cover the window opening with exterior edges of the cover disposed within the window frame or the exterior cover may be sized to cover the window frame. The method also includes providing a first interior clamping beam sized to be wider or longer than the window opening (or at least as wide or long as the window frame). The method also includes placing the exterior cover over the exterior of the window, placing the first interior clamping beam across the window and connecting the exterior cover to the clamping beam with a plurality of fasteners.

Other advantages and features will be apparent from the following detailed description when read in conjunction with the attached drawings.

BRIEF DESCRIPTION OF THE DRAWINGS

For a more complete understanding of the disclosed system and method, reference should be made to the embodiments illustrated in greater detail in the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and systems or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

Figure 1:
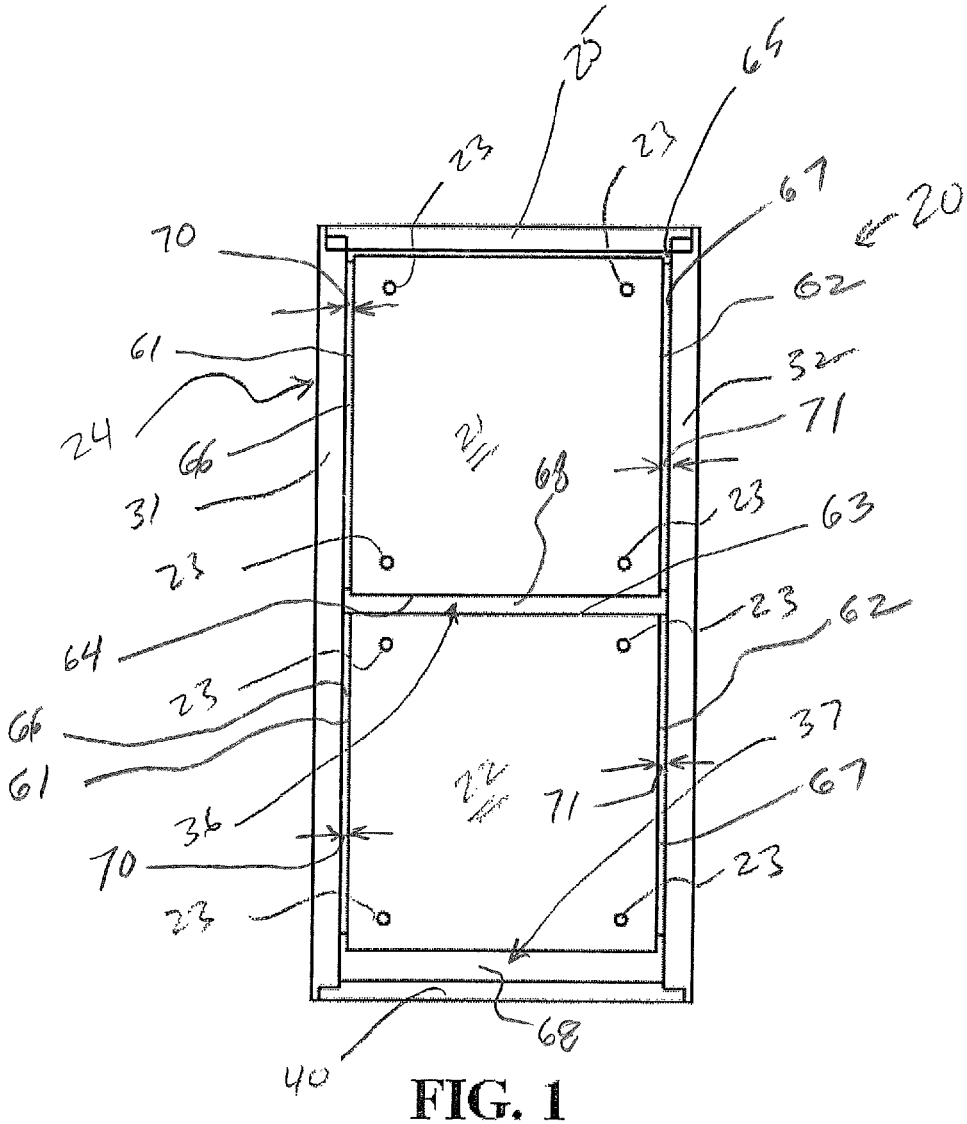
FIG. 1 is an exterior view of a first embodiment of a window with the internal anchor board-up system installed.
Figure 2:
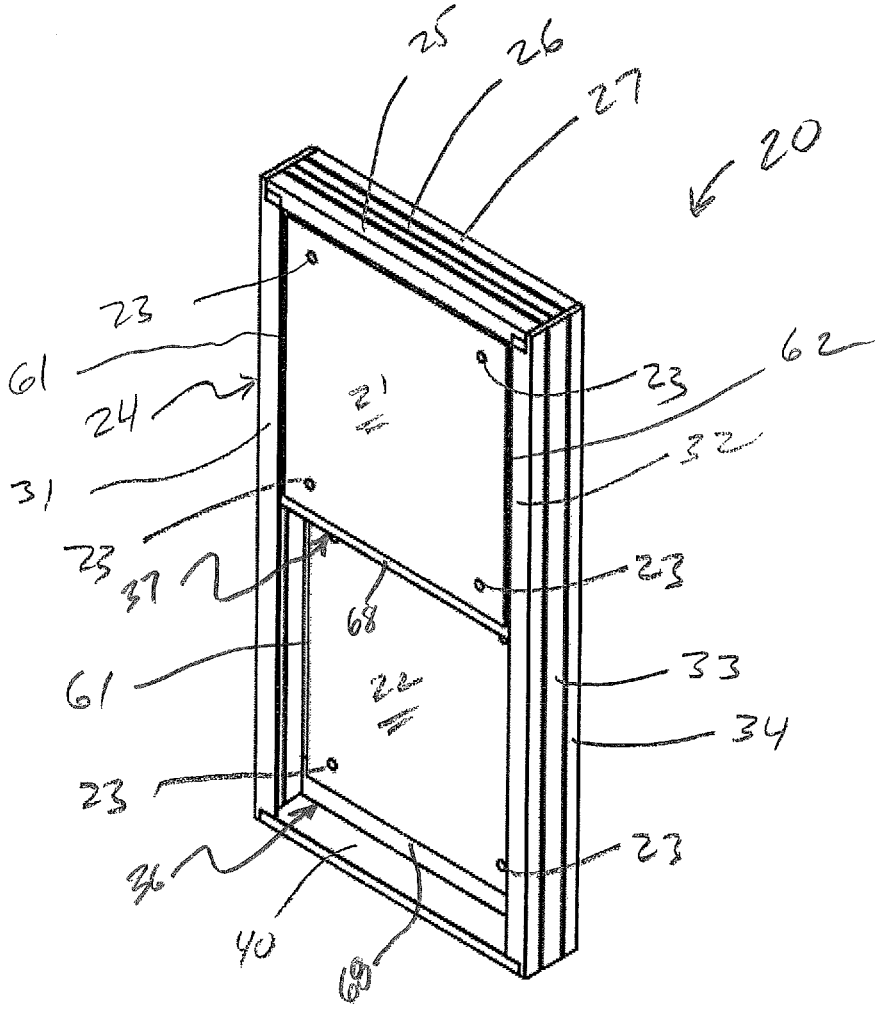
FIG. 2 is an exterior perspective view of the window in FIG. 1.

FIGS. 1-2 provide an exterior view of a window 20 equipped with two exterior covers 21, 22 that are fastened in place using a plurality of fasteners, such as bolts, shown at 23.

Figure 3:
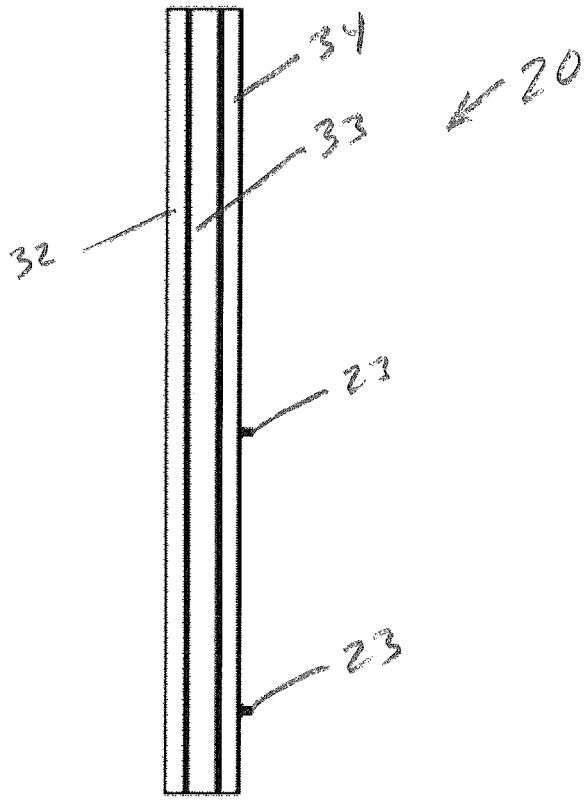
FIG. 3 is a side view of the window in FIG. 1.

Structurally, the window 20 includes a frame 24 that includes an exterior head casing 25 (FIG. 1), a middle head casing 26 and an interior head casing 27. The frame 24 also includes exterior side casings 31, 32 and the exterior side casings 31, 32 are disposed along a middle side casing 33 and an interior side casing 34 as shown in FIGS. 2-3. The windowsill is shown at 40 in FIGS. 1-2. The apron is shown at 55 in FIGS. 4-5.

Figure 4:
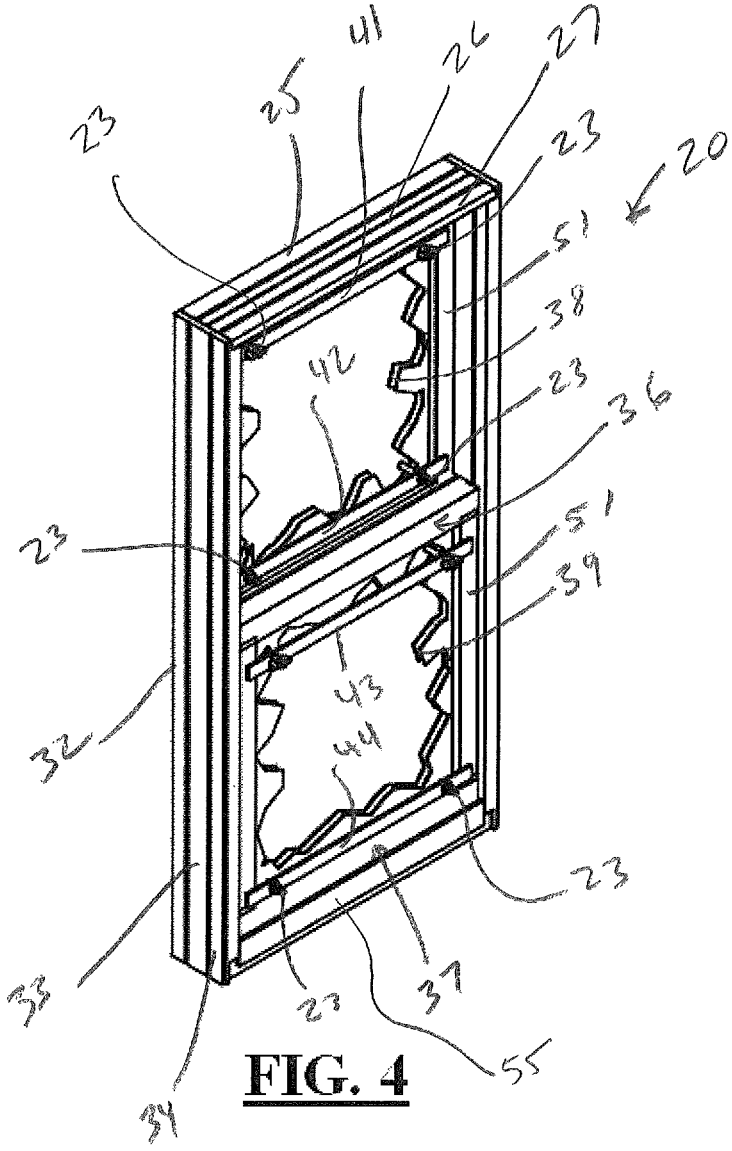
FIG. 4 is an interior perspective view of the window in FIG. 1.
Figure 5:
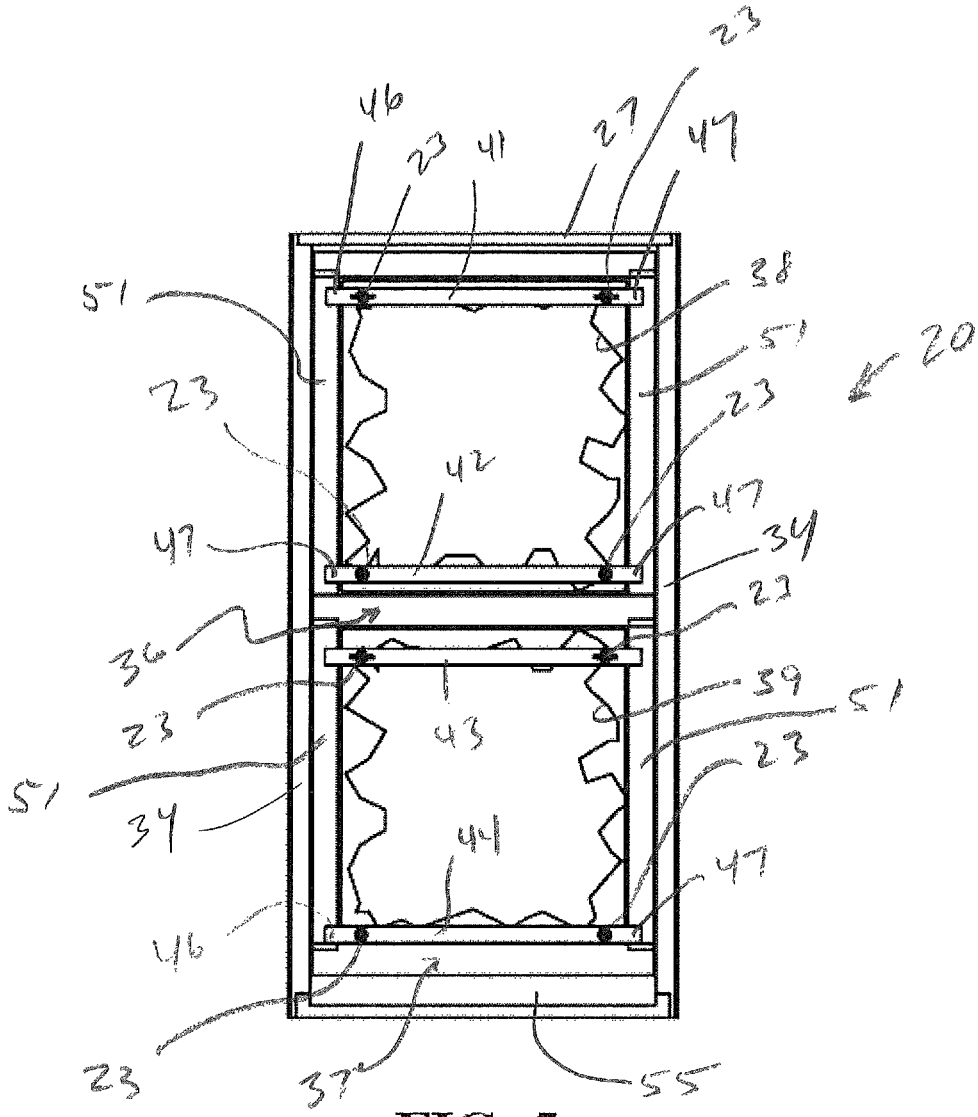
FIG. 5 is an interior view of the window in FIG. 1.
Figure 6:
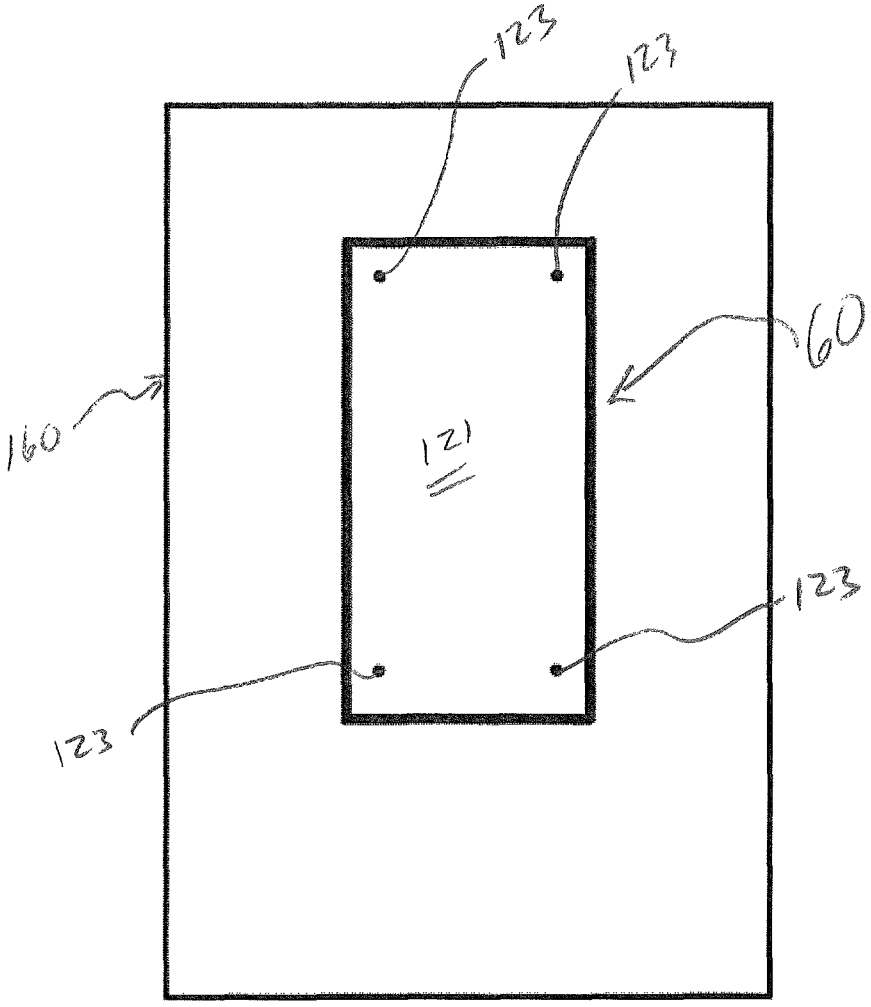
FIG. 6 is an exterior view of a second embodiment of a window with the internal anchor board-up system installed.

As shown in FIGS. 1-6, the window 20 may be a single or double hung window, meaning that one or both of the sashes 36, 37 move. In a double hung window, the upper sash 36 as well as the lower sash 37 move. In a single hung window, the lower sash 37 typically moves. As shown in FIGS. 4-5, both window panes 38, 39 have been broken. To secure the broken window 20, the exterior covers 21, 22 are held in place (preferably one at a time) as shown in FIGS. 1-2. Clamping beams 41-44 are then held in place (preferably one at a time) and fasteners 23 disposed at either opposing end 46, 47 of the beams 41-44 (see FIG. 5) are passed through openings in the exterior covers 21, 22 and openings in the clamping beams 41-44. Tightening the fasteners 23 provides a clamping force to secure the exterior covers 21, 22 in place.

The portions of the fasteners 23 disposed on the exterior side of the window 20 (FIGS. 1-2) may be a smooth head without a slot for a screw driver or without a geometrical shape to accommodate a wrench. The interior ends of the fasteners 23 as shown in FIGS. 4-5 may be equipped with a fictional tightening mechanism, such as a butterfly nut so that the tightening must be done from the inside the building but the situation where the fasteners 23 could be easily removed from outside of the building is avoided. In the embodiments illustrated in FIGS. 4-5, or clamping beams 41-44 are utilized in a horizontal and parallel orientation. The clamping beams 41-44 may also be used in a vertical orientation as well. Further, as shown in FIGS. 4-5, the clamping beams 41-44 are long enough to engage the side frame members 51 of the upper and lower sashes 36-37. Depending upon the design of the window 20, it may be desirable to have clamping beams 41-44 be longer so that they engage and press against the interior side casings 34.

Figure 7:
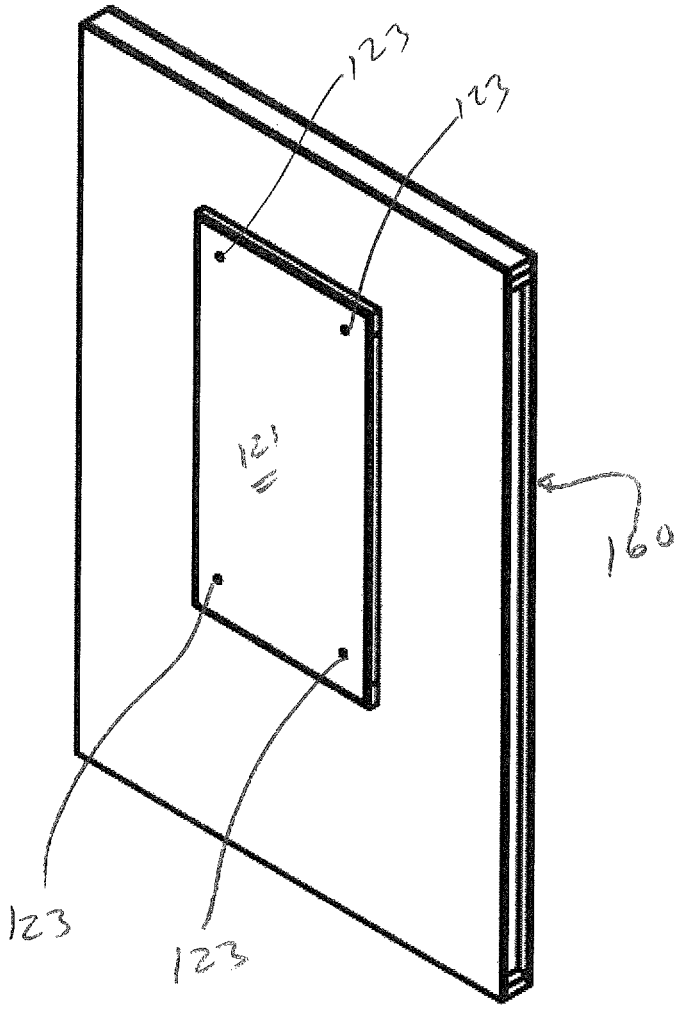
FIG. 7 is an exterior perspective view of the window in FIG. 6.
Figure 8:
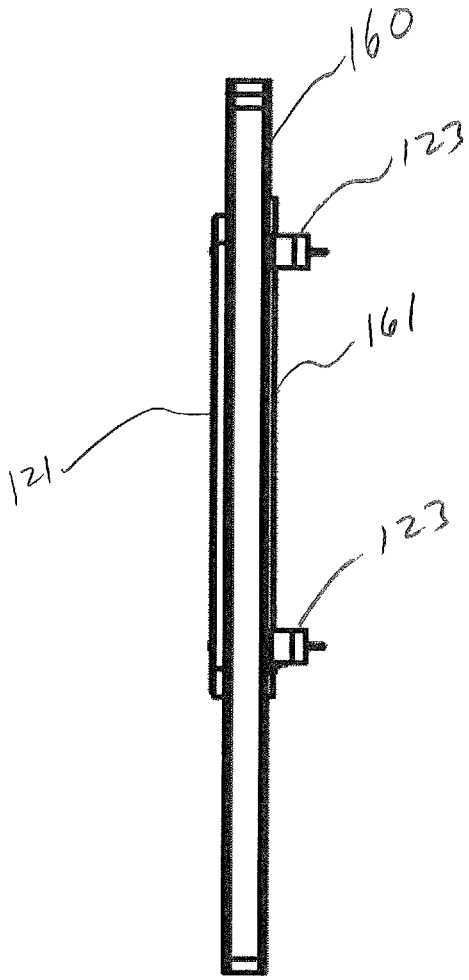
FIG. 8 is a side view of the window in FIG. 6.

Returning to FIGS. 6-8, an alternative window 60 is illustrated equipped with a protected exterior cover 121 that is fastened in place with fasteners 123. The outer structure 160 may be a window or a door. For example, the exterior cover 121 could be covering a hole in a window pane or, as shown in FIGS. 7-8, the structure 160 is most likely a door equipped with a window 60. Returning to FIG. 8, a side view is shown with the exterior cover 121 held in place with fasteners 123.

Figure 9:
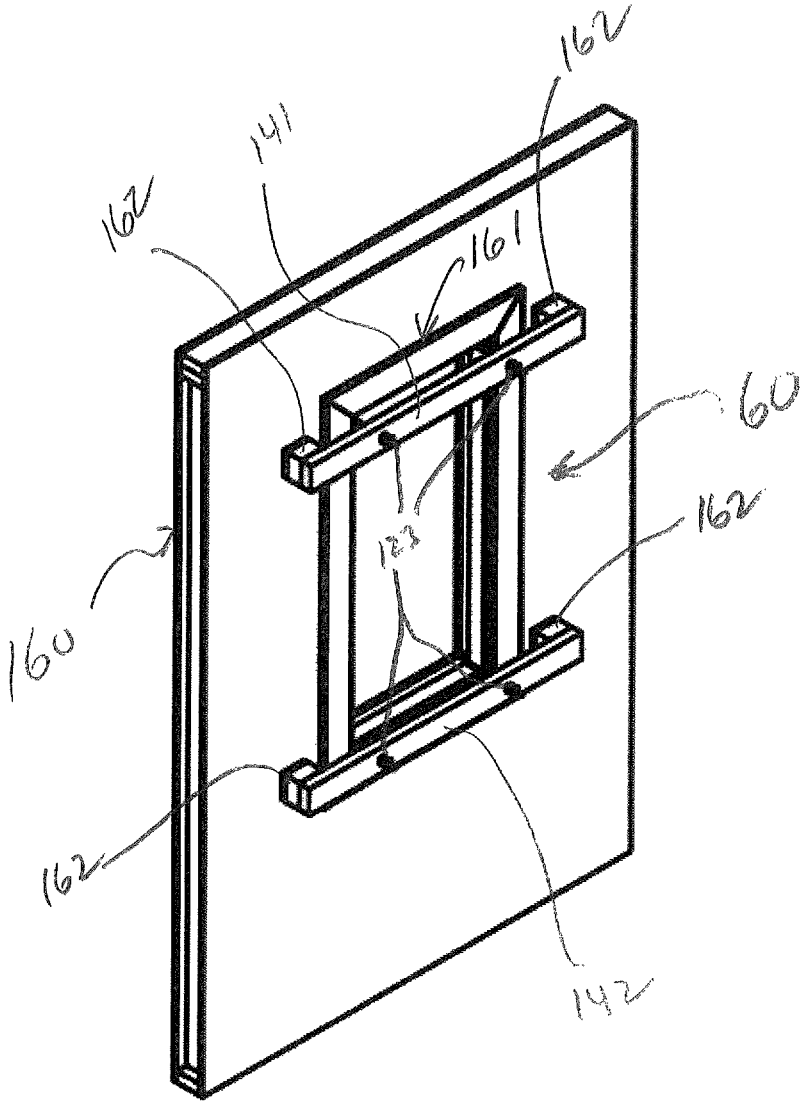
FIG. 9 is an interior perspective view of another window equipped with the disclosed anchor and board-up system.
Figure 10:
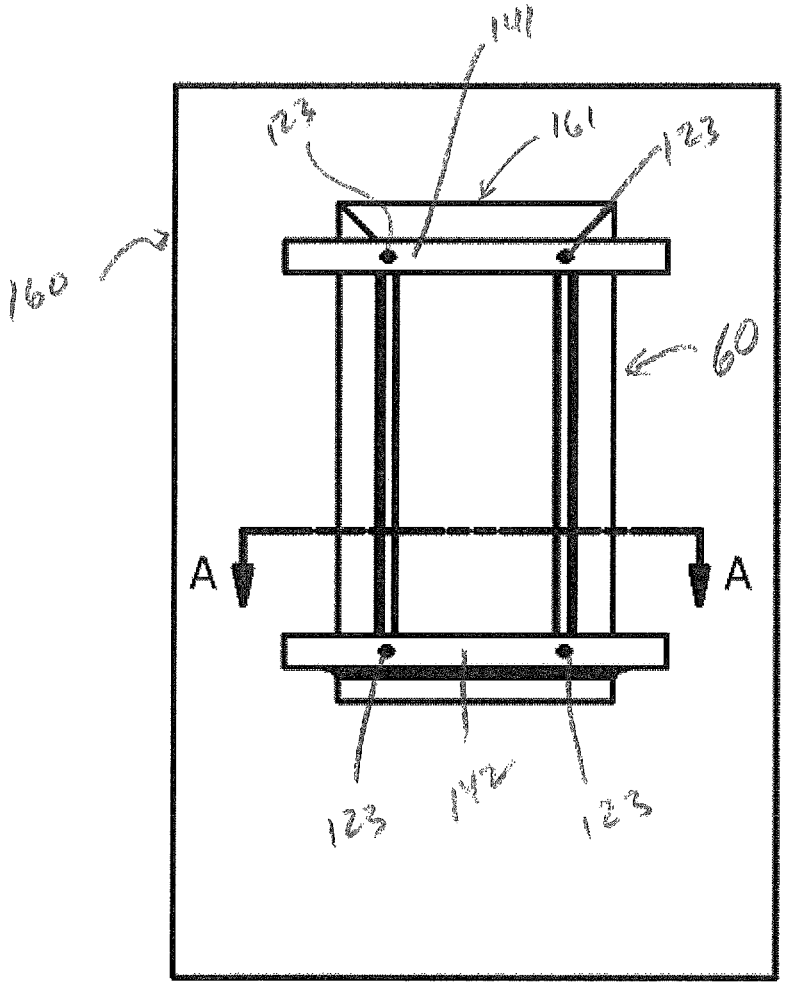
FIG. 10 is an interior plan view of the window in FIG. 9.
Figure 11:
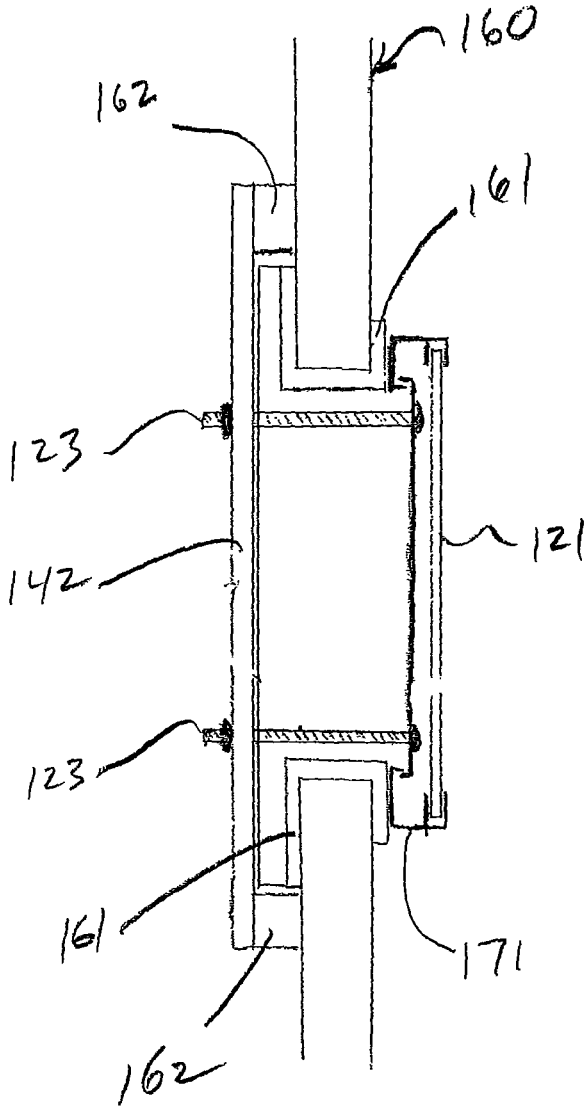
FIG. 11 is a top sectional view of the window in FIGS. 9 and 10 and taken substantially along line A-A of FIG. 10.

Turning to FIGS. 9-11, it will be noted that the window 60 as shown in FIG. 9 includes an encircling frame 161. Rather than damage the frame 161 by the clamping action of the clamping beams 141, 142, each clamping beam 141, 142 is equipped with a foot 162 that engages the door 160 (or other structure) thereby avoiding engagement with the clamping beams 141, 142 and the decorative frame 161.

Further, referring to FIG. 11, the exterior cover 121 is held in place by a frame 171, which may extend around all four sides of the cover 121. The frame 171 is secured to the exterior of the door 160 by the exterior clamp bar 172, which is secured to the door 160 by the fasteners 123 and the interior clamping beam 142.

INDUSTRIAL APPLICABILITY

The disclosed embodiments prevent or at least discourage the unauthorized entrance of an intruder into a building that has either been vacated or damaged. The disclosed embodiments may also be used for additional property protection during a natural disaster. The disclosed embodiments provide a minimally obstructed view from the interior of the property without creating damage to either the exterior or interior of the building.

There are three different types of windows: double-hung, casement and fixed. The disclosed embodiments will provide a secure cover-up with relatively minor differences between the three types.

The system comprises of three elements, the exterior window cover, the interior clamping beam and the connecting bolts between the cover and beam.

The exterior window covers 21, 22 are a clear polycarbonate sheets of between about ¼" and about ½" in thickness depending upon the window opening size and location within the building. The overall size of the covers 21, 22 will be such that the width between the opposing side edges 61, 62 will measure no more than ½" less horizontally than that of the side casings 31, 32 so the side edges 61, 62 rest on the side frame members 66, 67 with side gaps 70, 71 disposed between the side edges 61, 62 and the side casings 31, 32 as shown in FIG. 1. A hole 23 will be drilled into each of the four corners to allow a connecting bolt to pass through the covers 21, 22 without passing through the top frame members 65, the side frame members 66, 67 or the bottom frame members 68 of the sashes 36, 37 thereby avoiding any damage to the window sashes 36, 37, the head casing 25, the side casings 31, 32 or the window sill 40. If desired, the window covers 21, 22 could be provided as colored panels to eliminate visibility into the building.

The interior clamping beam may be about 2×4 (1.5"×3.5") in size and may be made from wood, metal, or a composite product. A beam should be about 8" greater in length than the horizontal measurement of the window casing from outside to outside. This length will allow for the placement of a foot with a rubber cushion to be attached at either end. The foot at either end will space the clamping beam beyond the thickness of the window casing, providing damage protection to the casing as well as the interior wall. Holes in the beam may line up with the holes horizontally in the exterior window cover.

The connecting bolts may be galvanized, non-slotted carriage bolts (e.g., ⅜"). The bolts should be of a length that will allow the bolt to pass through the exterior window cover and the interior clamping beam extending approximately 2" beyond the beam for screwing a nut with a washer onto it. The length is variable due to the many variations of building construction. Bolt selection may be made during installation.

Double hung and casement window sashes would normally be removed from the window frame prior to installation. In the event that removal of the double hung window sashes is not possible, the sashes may be moved to the middle of the frame to allow the connecting bolts to pass through. Fixed windows will require drilling of holes through the window sash at each of the four corners.

What is claimed is:

1. A system for securing a window pane framed by a pair of opposing side frame members, a top frame member and a bottom frame member, the frame members being surrounded by a pair of side casings, a head casing and a window sill, the system consisting essentially of:

an exterior polycarbonate cover including four corners and four through-holes wherein each of the four through-holes are each disposed diagonally inside one of the four corners, the cover including a pair of opposing side edges, a top edge and a bottom edge, the cover being sized so that the opposing side edges rest on the side frame members with two side gaps disposed between the side edges of the cover and the side casings, the two side gaps having a cumulative width of 0.5 inches or less;

a first interior clamping beam and a second interior clamping beam, each of the clamping beams including two opposite ends and only two through-holes with a single through-hole disposed inside each of the opposite ends, the first and second clamping beams being elongated and flat, wherein each end of each clamping beam includes a foot for engaging an interior surface of a building structure and supporting the clamping beams above said interior surface; and four threaded fasteners and four nuts, each fastener having a head connected to a threaded shaft that passes through one of the four corners of the cover and one of the through-holes inside the opposite ends of one of the beams, each head directly engaging the cover, each nut threadably engaging one of the threaded shafts for imposing a clamping force between the cover and one of the clamping beams.

2. The system of claim 1 wherein the first clamping beam and second clamping beam are disposed parallel to each other.

3. The system of claim 1 wherein the first clamping beam and second clamping beam are disposed parallel to each other and horizontally.

4. The system of claim 1 wherein the exterior cover is transparent.

5. A method for boarding up a window pane framed by a pair of opposing side frame members, a top frame member and a bottom frame member, the frame members being surrounded by a pair of side casings, a head casing and a window sill, the method consisting essentially of:

providing an exterior polycarbonate cover including four corners and four through-holes, each through-hole being disposed diagonally inside one of the four corners, the cover including a pair of opposing side edges, a top edge and a bottom edge, the cover being sized so that the opposing side edges rest on the side frame members with two side gaps disposed between the side edges of the cover and the side casings, the two side gaps having a cumulative width of 0.5 inches or less;

providing first and a second interior clamping beams sized to be wider or longer than a window opening, each clamping beam including two opposite ends and only two through-holes with a single through-hole disposed inside each of the opposite ends, the first and second clamping beams being elongated and flat, wherein each clamping beam includes a foot at each opposite end for engaging an interior surface of a building structure and supporting the clamping beams above said interior surface;

providing four threaded fasteners and four nuts, each fastener having a head connected to a threaded shaft, each nut for threadably engaging one of the threaded shafts;

placing the exterior cover over an exterior of the window pane;

placing the first interior clamping beam across an interior the window pane;

connecting the exterior cover to the first clamping beam with two of the threaded fasteners by passing one of the two threaded shafts through one of the through-holes in the cover so that each of said threaded shaft passes through one of said through-holes of the first clamping beam;

threadably engaging one nut on each of the two threaded shafts that have passed through the through-holes of the first clamping beam and clamping the first clamping beam and cover towards each other as each head directly engages the cover;

connecting the exterior cover to the second clamping beam with the two remaining threaded fasteners by passing one of the two threaded shafts through one of the remaining through-holes in the cover so that each threaded shaft passes through one of the through-holes of the second clamping beam; and threadably engaging one nut on each of the two threaded shafts that have passed through the through-holes of the second clamping beam and clamping the second clamping beam and cover towards each other.

6. The method of claim 5 wherein the first clamping beam and second clamping beam are disposed parallel to each other.

7. The method of claim 5 wherein the exterior cover is transparent.

8. A kit for boarding up a window pane framed by a pair of opposing side frame members, a top frame member and a bottom frame member, the frame members being surrounded by a pair of side casings, a head casing and a window sill, the kit consisting essentially of:

a first exterior polycarbonate cover with four corners and four through-holes, each through-hole being disposed diagonally inside one of the four corners, the cover including a pair of opposing side edges, a top edge and a bottom edge, the cover being sized so that the opposing side edges rest on the side frame members with two side gaps disposed between the side edges of the cover and the side casings, the two side gaps having a cumulative width of 0.5 inches or less;

a first interior clamping beam and a second interior clamping beam, each clamping beam including two opposite ends and only two through-holes with a single through-hole disposed inside each of the opposite ends, the first and second clamping beams being elongated and flat, wherein each clamping beam includes a foot at each opposite end for engaging an interior surface of a building structure and supporting the clamping beams above said interior surface; and four threaded fasteners and four nuts, each fastener having a head connected to a threaded shaft that passes through one of the four corners of the cover and one of the through-holes inside the opposite ends of one of the beams as the head directly engages the cover, each nut threadably engaging one of the threaded shafts for imposing a clamping force between the cover and one of the clamping beams.

9. The kit of claim 8 wherein the first clamping beam and second clamping beam are disposed parallel to each other and horizontally.

10. The kit of claim 8 wherein the exterior cover is transparent.

* * * * *